US005832991A

United States Patent [19]

Cesaroni

[11] Patent Number: 5,832,991

[45] Date of Patent: Nov. 10, 1998

[54] TUBE AND SHELL HEAT EXCHANGER WITH BAFFLE

[76] Inventor: Joseph Anthony Cesaroni, 9 Heathmore Court, Unionville, Ontario, Canada, L3R 8J1

[21] Appl. No.: 767,398

[22] Filed: Dec. 16, 1996

Related U.S. Application Data

[60] Provisional application No. 60/009,368 Dec. 29, 1995.

[51] Int. Cl.[6] ..... F28D 7/16

[52] U.S. Cl. ..... 165/160; 165/DIG. 406

[58] Field of Search ..... 165/159, 160, 165/DIG. 406

[56] References Cited

U.S. PATENT DOCUMENTS

| | | | |
|---|---|---|---|
| 948,835 | 2/1910 | Walter | 165/160 |
| 1,454,053 | 5/1923 | Jones | 165/DIG. 406 X |
| 1,782,409 | 11/1930 | Chute | 165/DIG. 406 X |
| 4,360,059 | 11/1982 | Funke | 165/160 |

FOREIGN PATENT DOCUMENTS

| | | | |
|---|---|---|---|
| 472627 | 4/1951 | Canada | 165/159 |
| 59-12294 | 1/1984 | Japan | 165/160 |
| 59-173695 | 10/1984 | Japan | 165/160 |
| 62-22995 | 1/1987 | Japan | 165/159 |

*Primary Examiner*—Allen J. Flanigan

[57] ABSTRACT

A tube and shell heat exchanger having inlet and outlet manifolds, a plurality of tubes extending between the manifolds and a shell extending between the manifolds and enveloping the tubes. The tube and shell heat exchanger has at least one baffle through which the tubes pass to locate and maintain the tubes in a spaced apart relationship. The baffle is comprised substantially in the shape of a helix of polymeric material that extends from the axis of the helix to the periphery of the helix. The tubes pass through the material in a spaced apart relationship with respect to each other and are spaced apart from the axis of the helix. The tube and shell heat exchanger is particularly intended for marine applications.

12 Claims, 3 Drawing Sheets

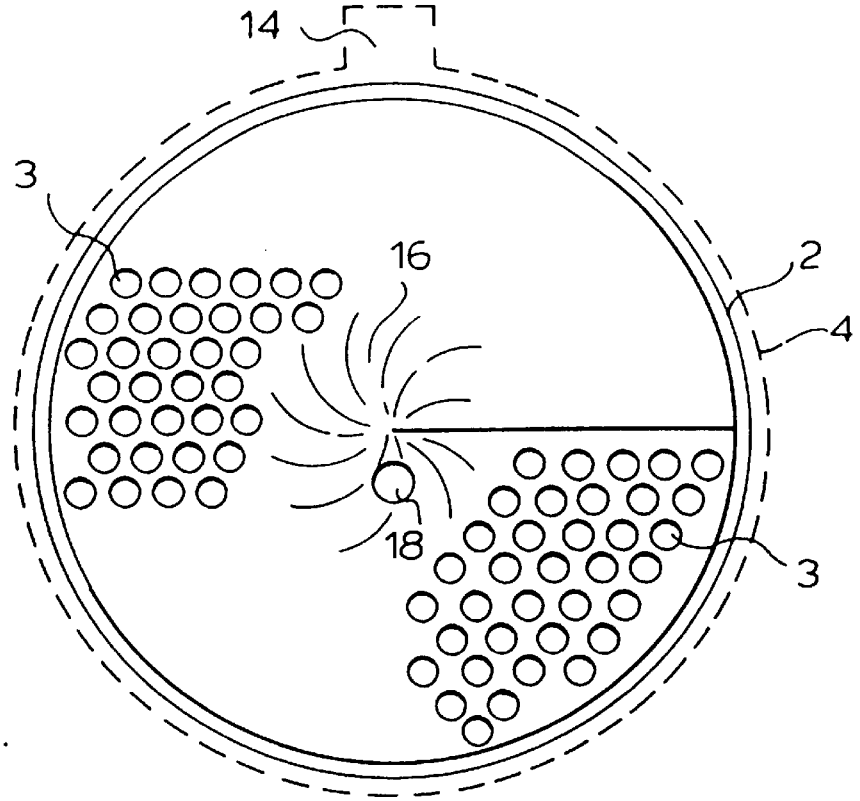
FIG. 2.
FIG. 3.
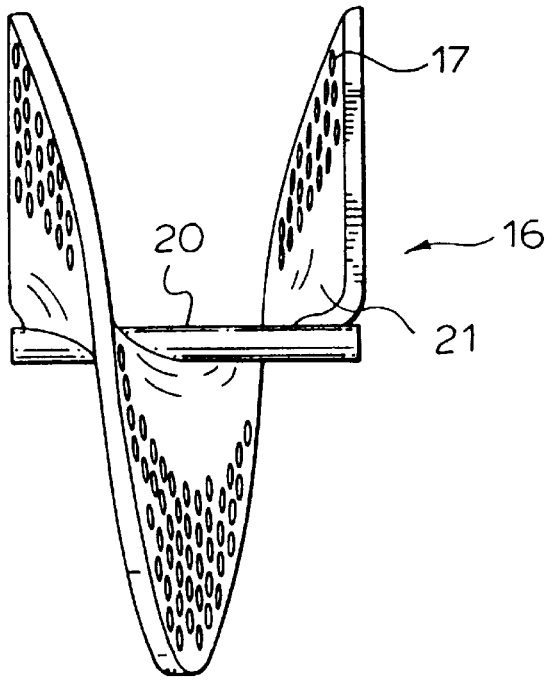

TUBE AND SHELL HEAT EXCHANGER WITH BAFFLE

This application claims the benefit of U.S. Provisional Application No. 60/009,368, filed Dec. 29, 1995.

FIELD OF THE INVENTION

The present invention relates to a tube and shell heat exchanger, especially a tube and shell heat exchanger fabricated from a thermoplastic polymer and intended for use in marine applications. Such heat exchangers use water as cooling fluid, generally using water from the environment e.g. river, lake or ocean, as the cooling fluid on the shell side of the heat exchanger. The tube and shell heat exchanger has a baffle that reduces the tendency for the heat exchanger to become blocked or plugged with sediment: or other material from the water.

BACKGROUND OF THE INVENTION

Tube and shell heat exchangers are used in a wide variety of applications. In these applications, one fluid is passed through the tubes (the "tube side") and a second fluid is passed through the shell of the heat exchanger i.e. around the tubes (the "shell side"). In some applications, the hotter fluid is passed through the tube and the cooler fluid is passed through the shell, whereas in other applications the fluids are reversed. The preferred way of operating the heat exchanger depends to a large extent on the nature of the fluids i.e. whether they are liquids or gases and the fluid-flow properties of the fluid.

One particular end use of tube and shell heat exchangers is in marine applications e.g. for cooling of motors on marine craft. In such applications, the cooling fluid is water from the environment on, or in which the craft is used e.g. the river, lake or ocean, and the cooling fluid is normally passed through the shell side of the heat exchanger. The hot fluid is passed through the tube and is generally oil or a coolant fluid.

Such heat exchangers in marine applications operate very effectively, provided that the water fed to the shell side is clean water. However, in many practical applications in marine use, the water may be contaminated with sediments, particulates, debris of various kinds, weeds or a variety of other materials. Some such contaminants will readily pass through the shell side of the heat exchanger without causing disruption in the operation of the heat exchanger. However, other contaminants will cause problems in operation of the heat exchanger. While suitable screens may be placed over the intake to the shell side of the heat exchanger to prevent large contaminant matter e.g. weeds from entering the heat exchanger, it is difficult to select screening for the intake that will permit flow of water through the heat exchanger at adequate flow rates without the risk of particulate matter entering the heat exchanger. Such particulate matter may become lodged between tubes in the heat exchanger and cause partial and ultimately complete blockage of the heat exchanger. Even partial blockages adversely affect the efficiency of the heat exchanger.

The use of baffles in tube and shell heat exchangers is well known. For instance, Canadian Patent No. 214,084, which issued Nov. 1, 1921, to R. C. Jones describes the use of baffles to form a circuitous pass for fluid from the inlet to the outlet of the shell side of a heat exchanger. Canadian Patent No. 796,085 of P. F. Brown et al, which issued Oct. 8, 1968, discloses the use of baffles to form a serpentine flow path and to maintain filamentary tubes in a desired array. The filamentary tubes are formed from a polymer. U.S. Pat. No. 3,439,738 of R. T. Dixon et al, which issued Apr. 22, 1969, describes a waste water heat exchanger having baffles. This patent makes reference to the use of back-flushing techniques to clean heat exchangers when obstructions are present to the flow of waste water through the heat exchanger, and then describes the use of baffles angled to the flow of the waste water in order to overcome this problem.

SUMMARY OF THE INVENTION

A tube and shell heat exchanger, having a baffle, has now been found that reduces the likelihood of partial or complete blocking or plugging of the shell side of the heat exchanger with sediment and other particulate matter in water in marine applications.

Accordingly, an aspect of the present invention provides a tube and shell heat exchanger, comprising:

an inlet manifold having a fluid inlet therein and an outlet manifold having a fluid outlet therein;

a plurality of tubes extending between said manifolds and in fluid-flow communication therewith;

a shell extending between said manifolds and enveloping said tubes, at least one baffle through which said tubes pass, to locate and maintain said tubes in a spaced apart relationship; the improvement comprising using a baffle substantially in the shape of a helix of a layer of polymeric material that extends from the axis of the helix to the periphery of the helix, said tubes passing through said material in a spaced apart relationship with respect to each other and spaced apart from the axis of the helix by a distance greater than the diameter of the fluid inlet, said helix extending through an arc of at least about 360°.

In a preferred embodiment of the invention, at least 25~ of the radius of the helix, measured from said axis, is free of such tubes.

In a further embodiment, the baffle has fluid-flow orifices located in the section of the helix free of tubes, especially juxtaposed to the axis of the helix.

In another embodiment, the arc of the helix is about 360°.

In particularly preferred embodiments, the heat exchanger is a marine heat exchanger.

In another aspect, the present invention provides a baffle for a tube and shell heat exchanger that is substantially in the shape of a helix of a layer of material, said layer of material extending from the axis of the helix to the periphery of the helix, said material having a plurality of tube holes for accommodating tubes of the tube and shell heat exchanger in a spaced apart relationship with respect to each other and spaced away from the axis of the helix such that at least 25% of the radius of the helix, as measured from the axis, is free of tube holes, said helix extending through an arc of at least about 360°.

BRIEF DESCRIPTION OF THE DRAWINGS

The present invention is illustrated by the embodiments shown in the drawings, in which:

FIG. 2 is a schematic representation of a cross section of a heat exchanger of FIG. 1 through A—A;

FIG. 3 is a schematic representation of a side view of the helical baffle of FIG. 1.

DETAILED DESCRIPTION OF THE INVENTION

Figure 1:
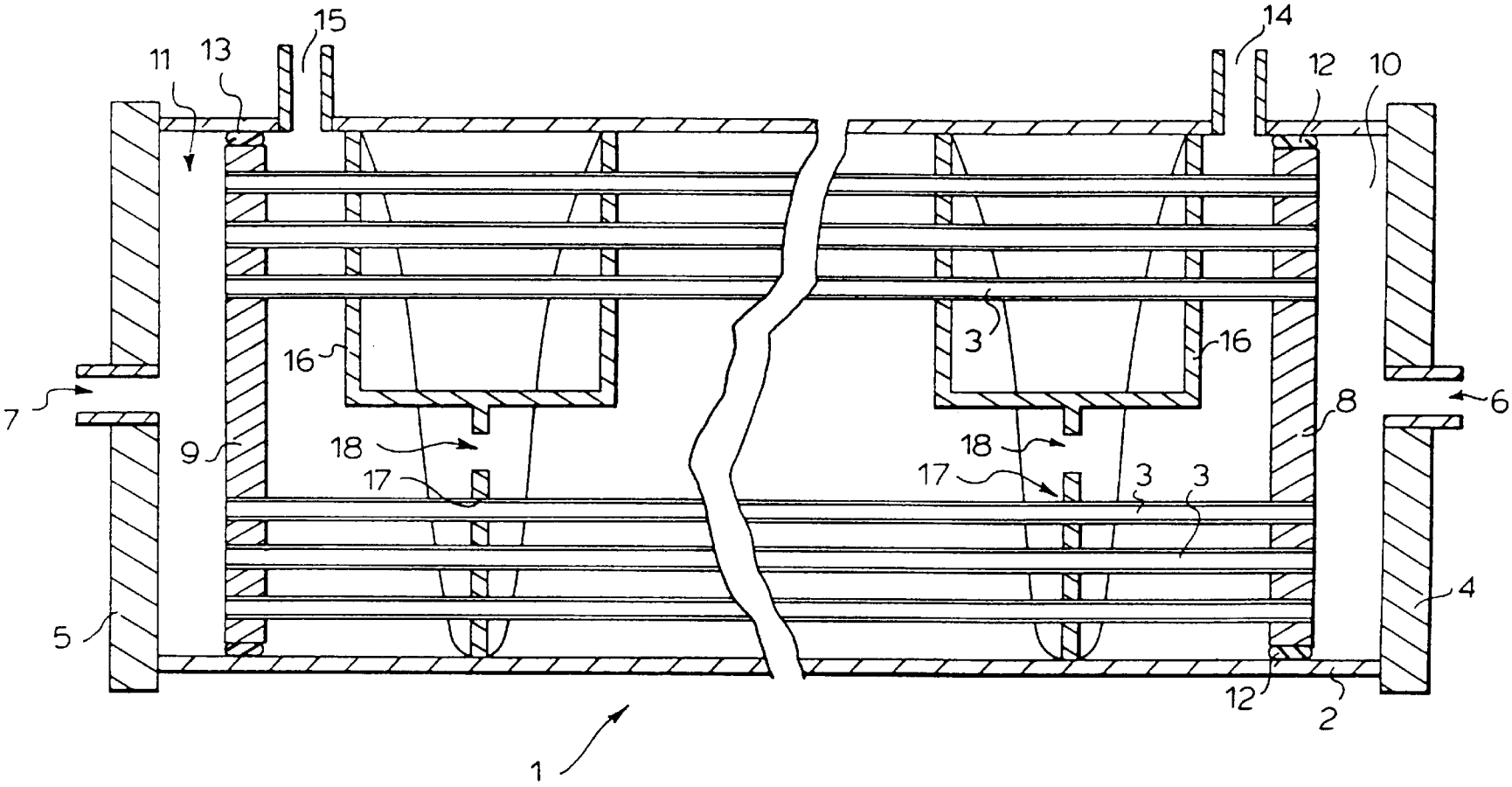
FIG. 1 is a schematic representation of a heat exchanger with a helical baffle.

FIG. 1 shows a tube and shell heat exchanger, generally indicated by 1. Heat exchanger 1 has a shell 2 and a plurality of tubes 3. Shell 2 extends from first (or inlet) end cap 4 to second (or outlet) end cap 5, with suitable means of attachment to retain the end caps on the shell (not shown). Inlet end cap 4 has manifold fluid inlet 6 therein, shown as being centrally located. Similarly, outlet end cap 5 has manifold fluid outlet 7 centrally located therein. Tubes 3 extend between inlet header plate 8 and outlet header plate 9. Tubes 3 provide fluid-flow communication between inlet manifold 10 and outlet manifold 11, passing through inlet header plate 8 and outlet header plate 9. Thus, the heat exchanger has a fluid-flow path from manifold fluid inlet 6, through inlet manifold 10, into tubes :3 which exit into outlet manifold 11 and through manifold fluid outlet 7.

Inlet header plate 8 is retained in position within shell 2 by means of inlet header O ring 12, providing a fluid tight seal between shell. 2 and inlet manifold 10. Similarly, outlet header O-ring 13 provides a seal between outlet header plate 9 and shell 2. Shell 2 has inlet 14 and outlet 15 for flow of fluid through the shell.

FIG. 1 shows the use of six tubes in the cross section shown in that drawing. However, it is to be understood that any number of tubes may be used, and such number is normally greater than six.

Baffles 16 are shown as located within shell 2. Baffles 16 act to retain tubes 3 in an aligned and desired location. Tubes 3 pass through baffle tube orifices 17. Baffle 16 is in the form of a helix. In addition, baffle fluid-flow orifice 18 is shown as located in baffle 16 between axis 20 and tubes 3. Baffle fluid-flow orifice 18 is optional, but if present, may be present as a single orifice or more than one orifice. Baffle fluid-flow-orifice 18 would normally be at least as large as baffle tube orifice 17.

Baffle 16 is characterized by a distance between axis 20 and the innermost of tubes 3 i.e., tube 3 that is closest to axis 20, that is greater than the diameter of manifold fluid inlet 6. It is also preferred that the innermost tube 3 be spaced from axis 20 by at least 25%, preferably at least 30~, of the diameter of baffle 6.

FIG. 2 shows a cross-section through A—A of FIG. 1. Baffle 16 is shown as extending across the entire internal diameter of shell 2, but does so in a helical fashion as more clearly seen in FIG. 3. Baffle tube orifice 17 is shown as passing through baffle 16 at a location between the axis of baffle 16 and tubes 3 therein. Baffle tube 17 is an optional orifice, as discussed herein.

Although baffle 16 is shown extending across the full width of shell 2, it is not necessary that it do so. It is understood that a small gap could remain between baffle 16 and shell 2, although it: is preferred that baffle 16 extend across essentially the full width of shell 2.

Figure 4:
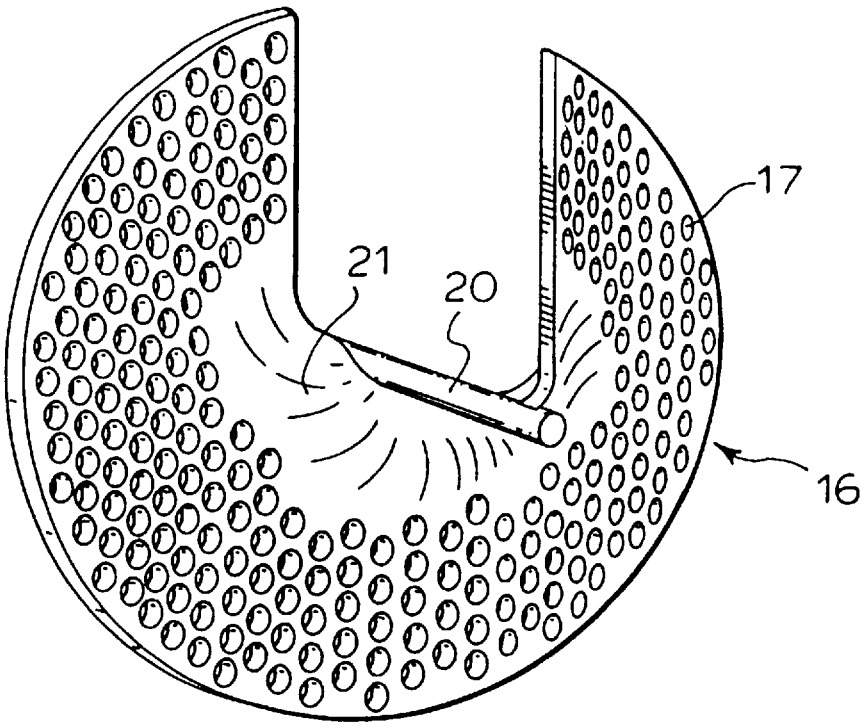
FIG. 4 is schematic representation of an end elevational view of the baffle of FIG. 1.

Baffle 16 is more clearly seen in FIG. 3 and FIG. 4. Baffle 16 has a plurality of baffle tube orifices 17. Such orifices are located towards the periphery of the helix. As shown, there are three rows of baffle tube orifices 17 extending around the baffle, but it is to be understood that any number of baffle orifices 17 could be used, corresponding to an equivalent number of tubes 3 within the tube and shell heat exchanger. Axial section 21 of baffle 16 is shown as being free of baffle tube orifices 17. A.', disclosed elsewhere, axial section 21 may contain one or more than one baffle fluid-orifices 18.

It will be understood by those skilled in the art that the relative proportions of fluid passing through one or more baffle fluid orifices 18, and around the arc of baffle 16 can be adjusted in the design of a particular heat exchanger to provide more or less flow of fluid bypassing tubes 3 and fluid passing between tubes 3. So long as enough fluid passes between tubes 3, the heat exchange goals will be met. As a practical example, it is common in marine applications to have one or more small heat exchangers connected in series with the main engine heat exchanger, such as for cooling the oil. With more of the fluid passing through orifices 18 and around baffle 16, such smaller heat exchangers can be designed to operate in a by-pass mode so there is less reduction in flow rate and less demand on pumping capacity.

As shown in FIG. 3, baffle 16 extends through an arc of 360° C. It is preferred that the arc of baffle 16 be at least about 360°, with about 360° being preferred, although the baffle may extend through a greater arc i.e. it may have a greater length. It is further understood that baffle 16 could have an arc of less than 360°, but if so additional baffles should be utilized to extend the arc through at least 360° without gaps to ensure that fluid does not flow directly through the tube and shell heat exchanger, to effectively provide a baffle extending through an arc of at least about 360° C.

FIG. 4 shows an end elevational view of baffle 16 as described herein.

In preferred embodiments, the shell and tube heat exchanger, especially the tubes and shell thereof, may be formed from a variety of polyamide compositions. The composition selected will depend primarily on the end use, especially the temperature of use and the environment of use of such a heat exchanger, including the fluids that will be passed through the heat exchanger, and the fluid e.g. air, external to the heat exchanger. In the case of use of such a heat exchanger on a marine craft, the fluid external to the heat exchanger may be air that at times contains salt or other corrosive or abrasive matter, or the fluid may be liquid e.g. radiator fluid, or the heat exchanger may be immersed in water, whether fresh water or salt water, or may be located within the craft and subjected to contact with oil or the like. It is also understood that the tubes will normally contact a hot fluid e.g. oil or radiator fluid, i.e. the fluid passed through the tubes, and that fresh or salt water will be circulated through the shell and around the exterior of the tubes.

A preferred polymer of construction is polyamide. Examples of polyamides are the polyamides formed by the condensation polymerization of an aliphatic dicarboxylic acid having 6–12 carbon atoms with an aliphatic primary diamine having 6–12 carbon atoms. Alternatively, the polyamide may be formed by condensation polymerization of an aliphatic lactam or alpha, omega aminocarboxylic acid having 6–12 carbon atoms. In addition, the polyamide may be formed by copolymerization of mixtures of such dicarboxylic acids, diamines, lactams and aminocarboxylic acids. Examples of dicarboxylic acids are 1,6-hexanedioic acid (adipic acid), 1,7-heptanedioic acid (pimelic acid), 1,8-octanedioic acid (suberic acid), 1,9-nonanedioic acid (azelaic acid), 1,10-decanedioic acid (sebacic acid) and 1,12-dodecanedioic acid. Examples of diamines are 1,6-hexamethylene diamine, 1,8-octamethylene diamine, 1,10-decamethylene diamine and 1,12-dodecamethylene diamine. An example of a lactam is caprolactam. Examples of alpha, omega aminocarboxylic acids are amino octanoic acid, amino decanoic acid, amino undecanoic acid and amino dodecanoic acid. Preferred examples of the polyamides are polyhexamethylene adipamide and polycaprolactam, which are also known as nylon 66 and nylon 6, respectively.

In preferred embodiments of the present invention, the tubing used in the fabrication of the shell and tube heat exchanger has a thickness of less than 0.7 mm, and especially in the range of 0.07–0.50 mm, particularly 0.12–0.30 mm. The thickness of the tubing will, however, depend to a significant extent on the proposed end use and especially the properties required for that end use.

The polymer compositions used in the fabrication of the heat exchangers may contain stabilizers, pigments, fillers, including glass fibres, and the like, as will be appreciated by those skilled in the art. Different compositions may be used for different parts of the heat exchanger.

All seals should be fluid tight seals, especially in a heat exchanger, to prevent leakage of fluid from the heat exchanger.

The present invention has provided a tube and shell heat exchanger that has a reduced tendency for plugging or blockage when used in marine applications. Matter that is of a size that could become lodged in the spaces between the tubes of the heat exchanger, thus resulting in partial or ultimately complete blocking of the heat exchanger, with adverse effects on the efficiency of the heat exchanger, tends to be swept clean from the tube and shell heat exchanger along the free space around the axis of the spiral baffle. Water free of such particulate matter, or containing small particulate matter, passes around the tubes of the heat exchanger to effect cooling of fluid within the tubes.

Although the tube and shell heat exchanger has been particularly described with respect to marine applications, it is understood that the heat exchanger may also be used in other end uses.

In particularly preferred embodiments, the tube and shell heat exchanger is intended for use on water craft that operate in rivers, lakes or in the ocean, and particularly in areas where particulate matter of a size that might clog the tube and shell heat exchanger could be encountered. Thus, the tube and shell heat exchanger is particularly intended for relatively small water craft.

The present invention is illustrated by the following examples.

EXAMPLE 1

A baffle substantially as shown in FIG. 2 and FIG. 3 was fabricated from nylon 66 containing carbon black pigment using an injection moulding process. The baffle was in the shape of a helix with an arc of 360°.

The helix of the baffle had a pattern of holes for accommodating tubes. The pattern of holes extended to juxtaposed the outer edge (periphery) of the helix and was substantially uniform. However, the number of rows of holes varied from four to six, but most generally was five.

The inner portion of the helix, measuring 35–40 percent of the radius of the helix as measured from the axis, was free of holes or tubes.

The baffle was installed in a tube and shell heat exchanger substantially as described herein, including with respect to inlet diameter, and which had been formed with tubes, shell and baffle ,all being fabricated from a polyamide.

I claim:

1. A tube and shell heat exchanger comprising:

an inlet manifold having a fluid inlet therein and an outlet manifold having a fluid outlet therein;

a plurality of tubes extending between said manifolds and in fluid-flow communication therewith;

a shell extending between said manifolds and enveloping said tubes, at least one baffle through which said tubes pass, to locate and maintain said tubes in a spaced apart relationship; the improvement comprising using a baffle substantially in the shape of a helix of a layer of polymeric material that extends from an elongate support member extending along the axis of the helix to the periphery of the helix, said tubes passing through said material in a spaced apart relationship with respect to each other and spaced apart from elongate support member by a distance greater than the diameter of the fluid inlet to reduce the tendency for blockage when used in marine applications, said helix extending through an arc of at least about 360°.

2. The tubes and shell heat exchanger of claim 1 in which said tubes are spaced apart from the axis of the helix such that at least 25% of the radius of the helix, as measured from said axis, is free of such tubes.

3. The tube and shell heat exchanger of claim 2 in which the arc of the helix is about 360°.

4. The tube and shell heat exchanger of claim 2 in which a series of baffles provides a helix with an arc of at least about 360°.

5. A tube and shell heat exchanger comprising:

an inlet manifold having a fluid inlet therein and an outlet manifold having a fluid outlet therein:

a plurality of tubes extending between said manifolds and in fluid-flow communication therewith;

a shell extending between said manifolds and enveloping said tubes, at least one baffle through which said tubes pass, to locate and maintain said tubes in a spaced apart relationship; the improvement comprising using a baffle substantially in the shape of a helix of a layer of polymeric material that extends from the axis of the helix to the periphery of the helix, said tubes passing through said material in a spaced apart relationship with respect to each other and spaced apart from the axis of the helix by a distance greater than the diameter of the fluid inlet to reduce the tendency for blockage when used in marine applications, to reduce the tendency for blockage when used in marine applications, said helix extending through an arc of at least about 360°, in which the baffle has fluid-flow orifices located on the section of the helix that is free of tubes.

6. The tube and shell heat exchanger of claim 5 in which the fluid-flow orifices are juxtaposed to the axis of the helix.

7. The tube and shell heat exchanger of claim 1 in which said tubes, shell and baffle are fabricated from aliphatic polyamide.

8. A baffle for a tube and shell heat exchanger that is substantially in the shape of a helix of a layer of material, said layer of material extending from an elongate support member extending along the axis of the helix to the periphery of the helix, said material having a plurality of tube holes for accommodating tubes of the tube and shell heat exchanger in a spaced apart relationship with respect to each other and spaced away from elongate support member such that at least 25% of the radius of the helix, as measured from the elongate support member, is free of tube holes to reduce the tendency for blockage when used in marine applications, said helix extending through an arc of at least about 360°.

9. The baffle of claim 8 in which the arc of the helix is about 360°.

10. A baffle for a tube and shell heat exchanger that is substantially in the shape of a helix of a layer of material, said layer of material extending from the axis of the helix to the periphery of the helix, said material having a plurality of tube holes for accommodating tubes of the tube and shell heat exchanger in a spaced apart relationship with respect to each other and spaced away from the axis of the helix such that at least 25% of the radius of the helix, as measured from the axis, is free of tube holes to reduce the tendency for blockage when used in marine applications, said helix extending through an arc of at least about 360°, in which the baffle has fluid-flow orifices located on the section of the helix that is free of tubes.

11. The baffle of claim 10 in which the fluid-flow orifices are juxtaposed to the axis of the helix.

12. The baffle of claim 8 when fabricated from aliphatic polyamide.

* * * * *